US011382807B2

(12) United States Patent
Su et al.

(10) Patent No.: US 11,382,807 B2
(45) Date of Patent: Jul. 12, 2022

(54) DISPLACEMENT MECHANISM FOR GETTING DISABLED PERSON INTO AND OUT OF CAR

(71) Applicants: Chien-Chung Su, Taichung (TW); Hsin-Liang Han, Taichung (TW)

(72) Inventors: Chien-Chung Su, Taichung (TW); Hsuan-Jang Su, Taichung (TW)

(73) Assignees: Chien-Chung Su, Taichung (TW); Hsin-Liang Han, Taichung (TW)

( * ) Notice: Subject to any disclaimer, the term of this patent is extended or adjusted under 35 U.S.C. 154(b) by 0 days.

(21) Appl. No.: 17/209,452

(22) Filed: Mar. 23, 2021

(65) Prior Publication Data

US 2021/0315750 A1 Oct. 14, 2021

(30) Foreign Application Priority Data

Apr. 9, 2020 (TW) ..... 109112070

(51) Int. Cl.
*A61G 3/06* (2006.01)
*A61G 5/10* (2006.01)

(52) U.S. Cl.
CPC ..... *A61G 3/062* (2013.01); *A61G 5/104* (2013.01); *A61G 2220/14* (2013.01)

(58) Field of Classification Search
CPC .... A61G 2220/14; A61G 5/1059; A61G 5/00; A61G 5/104; A61G 3/062
See application file for complete search history.

(56) References Cited

U.S. PATENT DOCUMENTS

2007/0164539 A1* 7/2007 Chung ..... A61G 5/00 280/647
2011/0002764 A1* 1/2011 Darnell ..... A61G 3/062 414/550
2011/0068599 A1* 3/2011 Panzarella ..... A61G 3/062 296/65.11
2013/0334856 A1* 12/2013 Weersink ..... B60N 2/1665 297/344.12
2018/0036191 A1* 2/2018 Vallejo Pineda ..... A61G 5/125
2018/0193210 A1* 7/2018 Aitchison ..... B60N 2/14
2019/0076313 A1* 3/2019 Choi ..... A61G 7/1015

FOREIGN PATENT DOCUMENTS

JP 2014015147 A * 1/2014 ..... A61G 3/062

* cited by examiner

*Primary Examiner* — Kaitlin S Joerger
(74) *Attorney, Agent, or Firm* — Karin L. Williams; Alan D. Kamrath; Mayer & Williams PC

(57) ABSTRACT

A displacement mechanism contains: a support rack, a sitting assembly, a slide rod, two fixing feet, a back, a first holding plate, a second holding plate, and an expandable sheet. The support rack includes a fixer having a post, a rolling stand having multiple first rollers, and a lifter. The sitting assembly includes a receiving orifice and a rotatable mounting. The slide rod includes an elongated hole for connecting the slide rod with the post. A respective foot includes a second roller. The back is disposed on a rear end of the sitting assembly. The first holding plate is mounted on a seat of a wheelchair, and the sitting assembly is slid between the fixer and the first holding plate. The second holding plate is connected on a seat of a car. The expandable sheet is disposed between the fixer and the second holding plate.

7 Claims, 17 Drawing Sheets

DISPLACEMENT MECHANISM FOR GETTING DISABLED PERSON INTO AND OUT OF CAR

BACKGROUND OF THE INVENTION

Field of the Invention

The present invention relates to a displacement mechanism, and more particularly to the displacement mechanism which is capable of moving a disabled person to getting into and out of a car.

Description of the Prior Art

There are many tools (such as a wheelchair) to assist a patient and a disabled person to move, but it is difficult to move the patient and the disabled person to get into and out of the car. To solve such a problem, a caregiver (such as a female caregiver) has to move the patient and the disabled person physically. Furthermore, the disabled person will be hurt during being moved.

To improve such a defect, a conventional displacement mechanism has been developed, but it is complicated, produced at a high cost, sold at a high price, and is operated arduously.

The present invention has arisen to mitigate and/or obviate the afore-described disadvantages.

SUMMARY OF THE INVENTION

The primary object of the present invention is to provide a displacement mechanism which is simplified, produced at a low cost, sold at a low price, and used flexibly.

Another object of the present invention is to provide a displacement mechanism which is capable of moving the disabled person upward and downward easily and quickly.

To obtain above-mentioned aspect, a displacement mechanism provided by the present invention contains: a support rack, a sitting assembly, a slide rod, two fixing feet, a back, a first holding plate, a second holding plate, and an expandable sheet.

The support rack includes a fixer formed on a top of the support rack, a rolling stand connected on a bottom of the support rack. The rolling stand has multiple first rollers mounted on a bottom of the rolling stand, and the support rack further includes a lifter defined between the fixer and the rolling stand. The fixer has a post extending upward from a side thereof.

The sitting assembly is slidably mounted on the fixer of the support rack, the sitting assembly includes a receiving orifice defined on one of two side surfaces of the sitting assembly, and the sitting assembly includes a rotatable mounting rotatably connected on a front end of the sitting assembly.

The slide rod includes an elongated hole defined on the slide rod and configured to connect the slide rod with the post of support rack, such that the slide rod slides with respect to the post and is slidably received in the receiving orifice of the sitting assembly.

The two fixing feet is mounted on two bottoms of two side surfaces of the rotatable mounting, and a respective foot includes a second roller connected on a bottom of the respective foot.

The back is disposed on a rear end of the sitting assembly.

The first holding plate is mounted on a seat of a wheelchair, and the sitting assembly is slid between the fixer of the support rack and the first holding plate.

The second holding plate is connected on a seat of a car.

The expandable sheet is disposed between the fixer of the support rack and the second holding plate so that the sitting assembly slides between the fixer of the support rack and the second holding plate.

DETAILED DESCRIPTION OF THE PREFERRED EMBODIMENTS

The present invention will be clearer from the following description when viewed together with the accompanying drawings, which show, for purpose of illustrations only, a preferred embodiment in accordance with the present invention.

Figure 1:
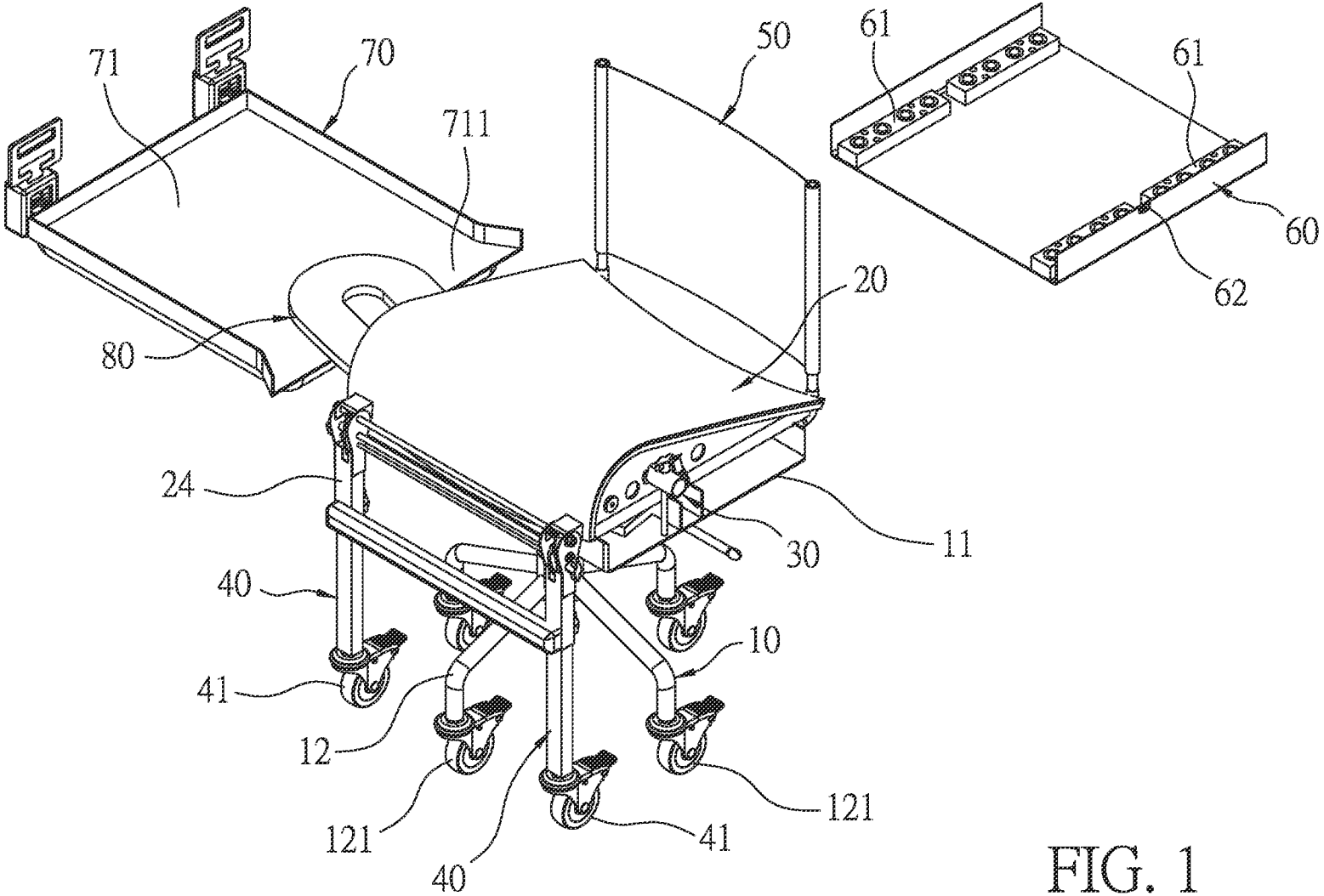
FIG. 1 is a perspective view showing the exploded components of a displacement mechanism according to a preferred embodiment of the present invention.
Figure 2:
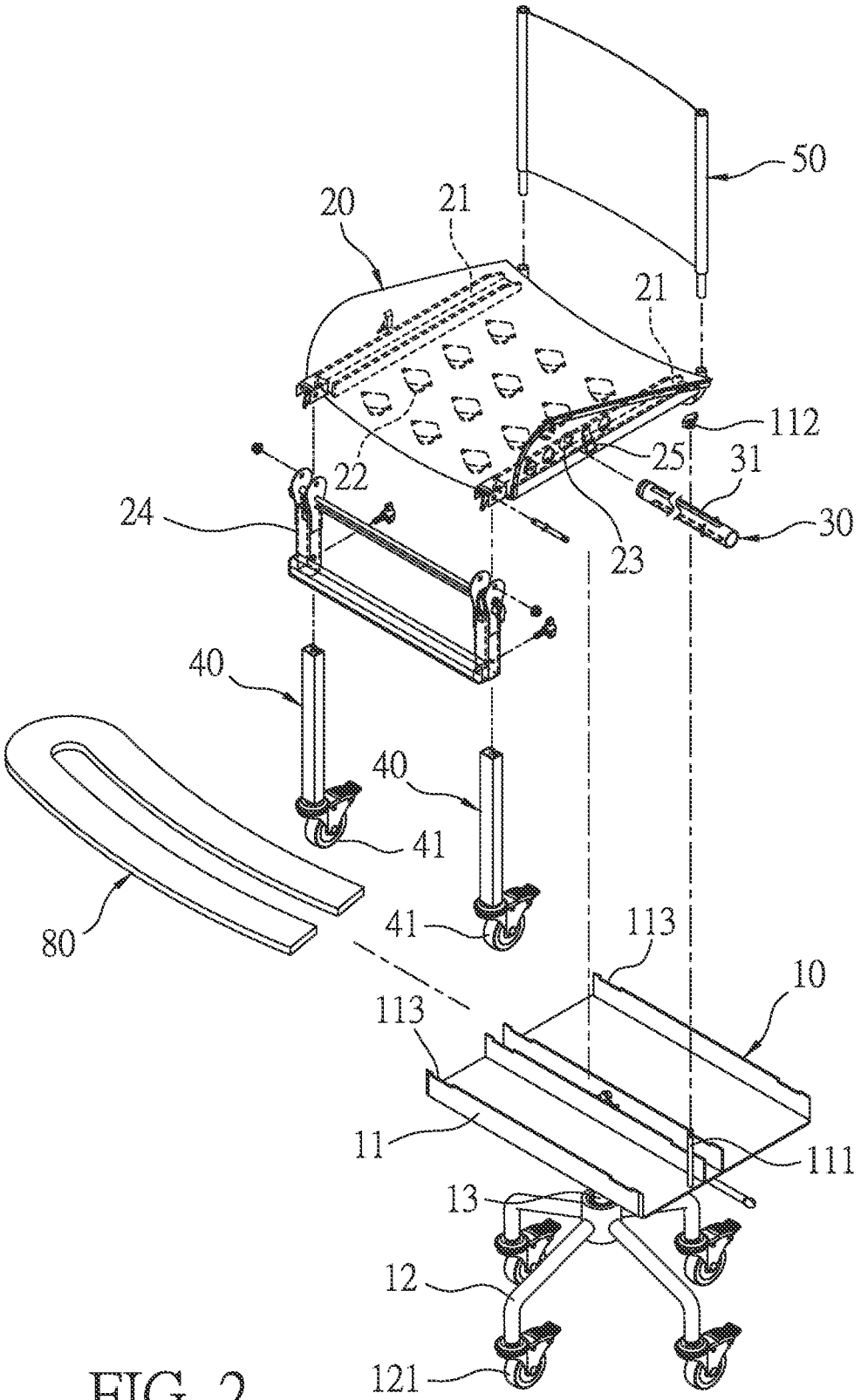
FIG. 2 is a perspective view showing the exploded components of a part of the displacement mechanism according to the preferred embodiment of the present invention.
Figure 3:
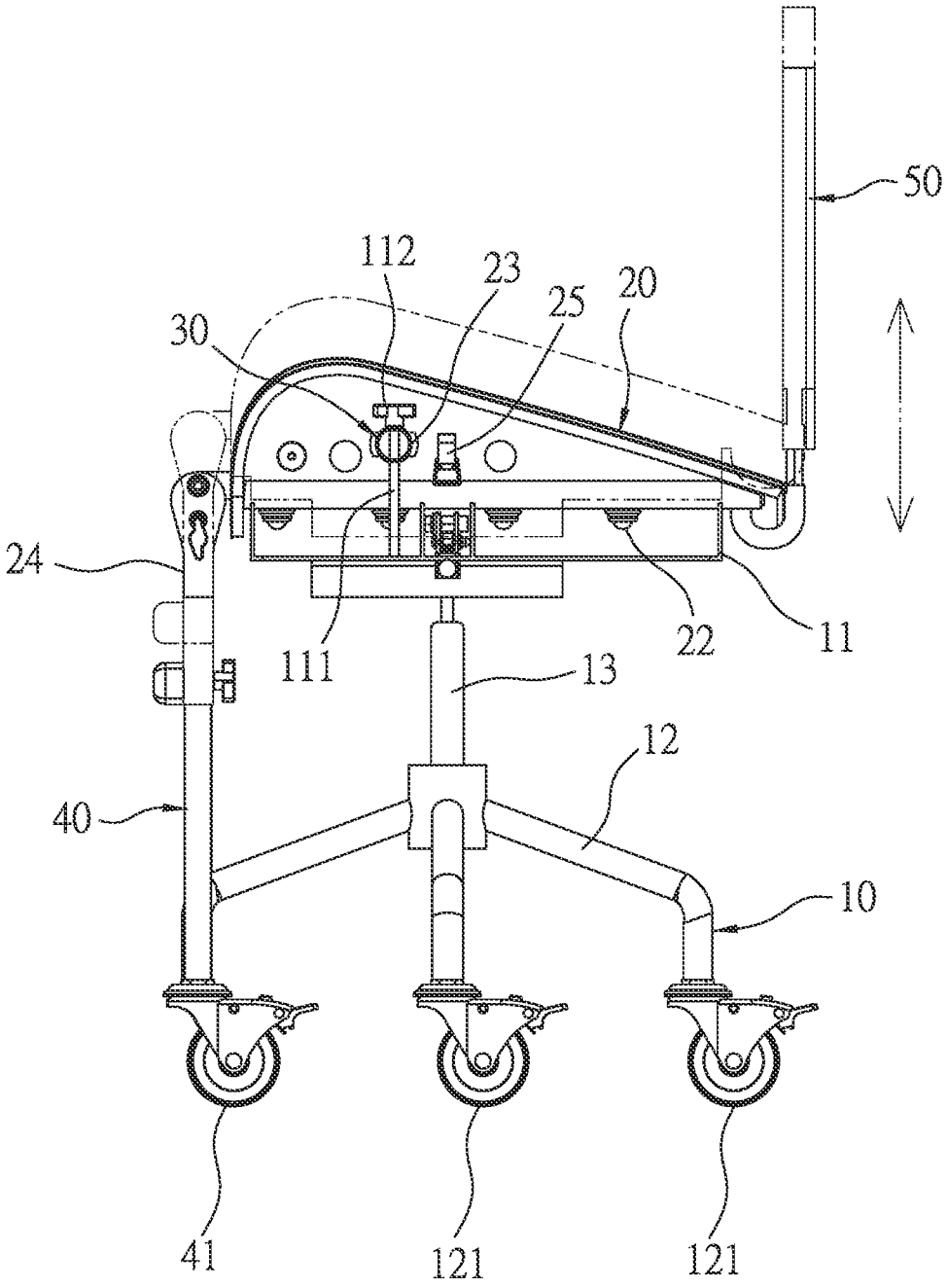
FIG. 3 is a side plan view showing the operation of a sitting assembly of the displacement mechanism according to the preferred embodiment of the present invention.

With reference to FIGS. 1-3, a displacement mechanism for getting a disabled person into and out of a car according to a preferred embodiment of the present invention comprises: a support rack 10, a sitting assembly 20, a slide rod 30, two fixing feet 40, a back 50, a first holding plate 60, a second holding plate 70, and an expandable sheet 80.

The support rack 10 includes a fixer 11 formed on a top thereof, and the support rack 10 includes a rolling stand 12 connected on a bottom of the support rack 10, wherein the rolling stand 12 has multiple first rollers 121 mounted on a bottom thereof and configured to move the support rack 10 slidably. The support rack 10 further includes a lifter 13 defined between the fixer 11 and the rolling stand 12 and configured to adjust a height of the fixer 11, wherein the fixer 11 has a post 111 extending upward from a side thereof, a screw nut 112 screwed on the post 111, and multiple cutouts 113 formed on two sides of a top of the fixer 11.

The sitting assembly 20 includes two first slide rails 21 arranged on two sides of a bottom thereof and configured to fix the sitting assembly 20 on the fixer 11 of the support rack 10, the two first slide rails 21 are engaged with the multiple cutouts 113 of the fixer 11 of the support rack 10, and the sitting assembly 20 further includes multiple rotation elements 22 disposed between the two first slide rails 21 of the bottom of the sitting assembly 20, a receiving orifice 23 defined on one of two side surfaces the sitting assembly 20, a rotatable mounting 24 rotatably connected on a front end of the sitting assembly 20, and two retainers 25 fixed on the two side surfaces of the sitting assembly 20.

The slide rod 30 includes an elongated hole 31 defined thereon and configured to screw the slide rod 30 with the post 111, such that the slide rod 30 slides with respect to the post 111 and is slidably received in the receiving orifice 23 of the sitting assembly 20.

The two fixing feet 40 are mounted on two bottoms of two side surfaces of the rotatable mounting 24, and a respective fixing foot 40 includes a second roller 41 connected on a bottom thereof.

The back 50 is detachably disposed on a rear end of the sitting assembly 20.

Figure 4:
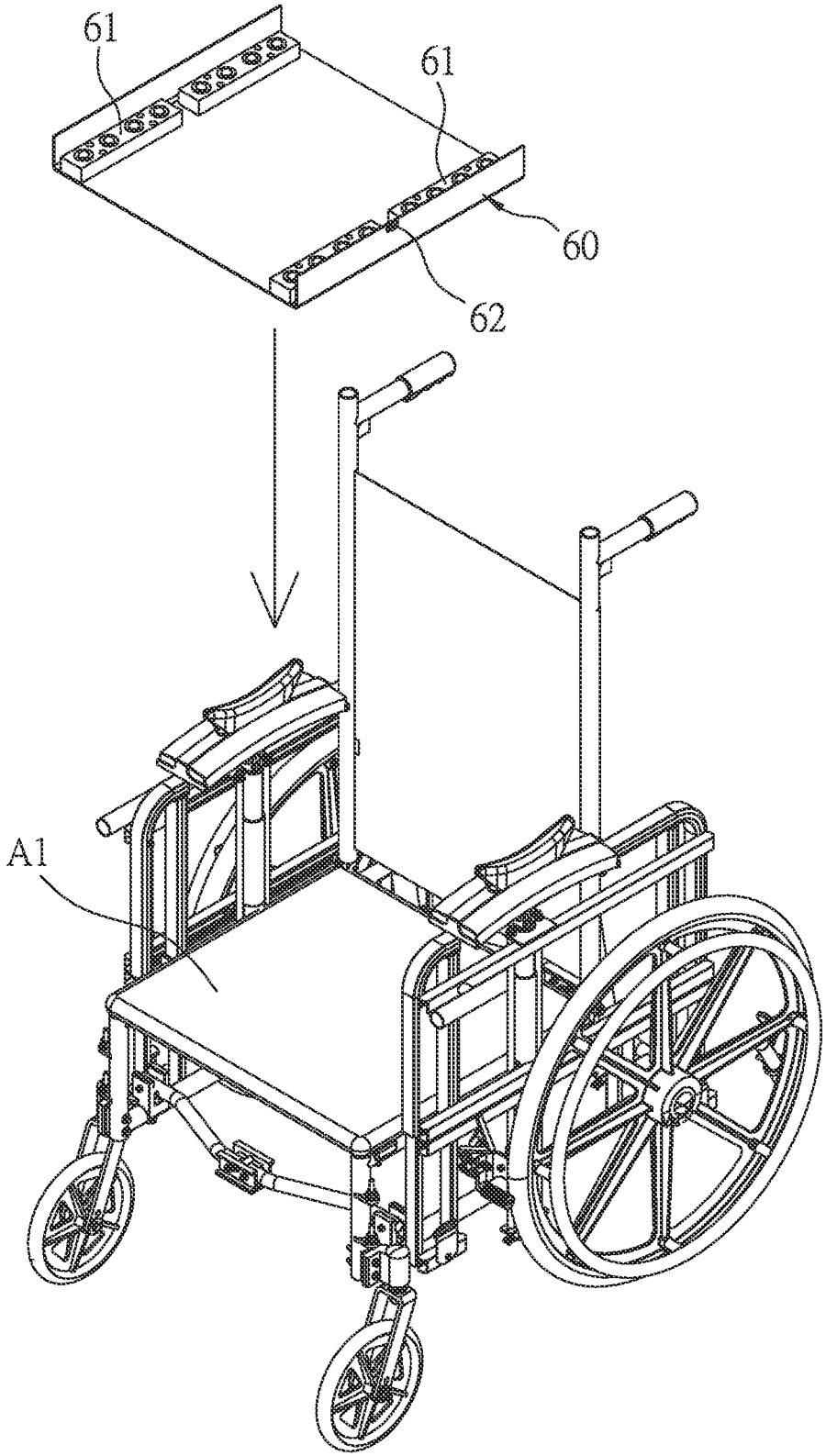
FIG. 4 is a perspective view showing the operation of a first holding plate of the displacement mechanism according to the preferred embodiment of the present invention.
Figure 5:
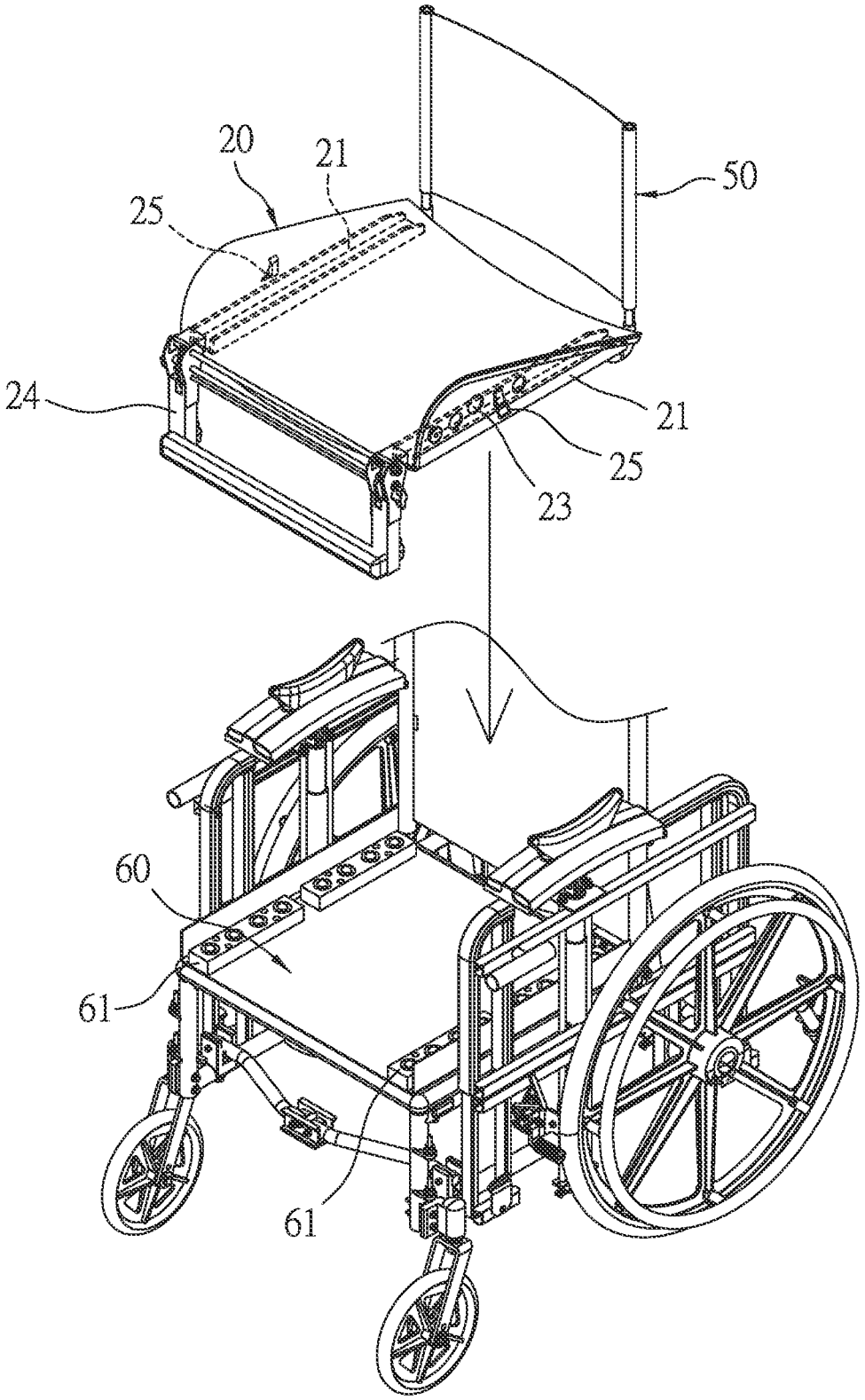
FIG. 5 is a perspective view showing the operation of the sitting assembly of the displacement mechanism according to the preferred embodiment of the present invention.

The first holding plate 60 is mounted on a seat A1 of a wheelchair (as shown in FIGS. 4 and 5), the first holding plate 60 includes two second slide rails 61 formed on two sides of a top thereof, and the first holding plate 60 includes two hooks 62 formed on two side surfaces thereof, such that the sitting assembly 20 slides between the fixer 11 of the support rack 10 and the first holding plate 60 by way of the first slide rails 21 of the sitting assembly 20 and the second slide rails 61 of the first holding plate 60.

Figure 9:
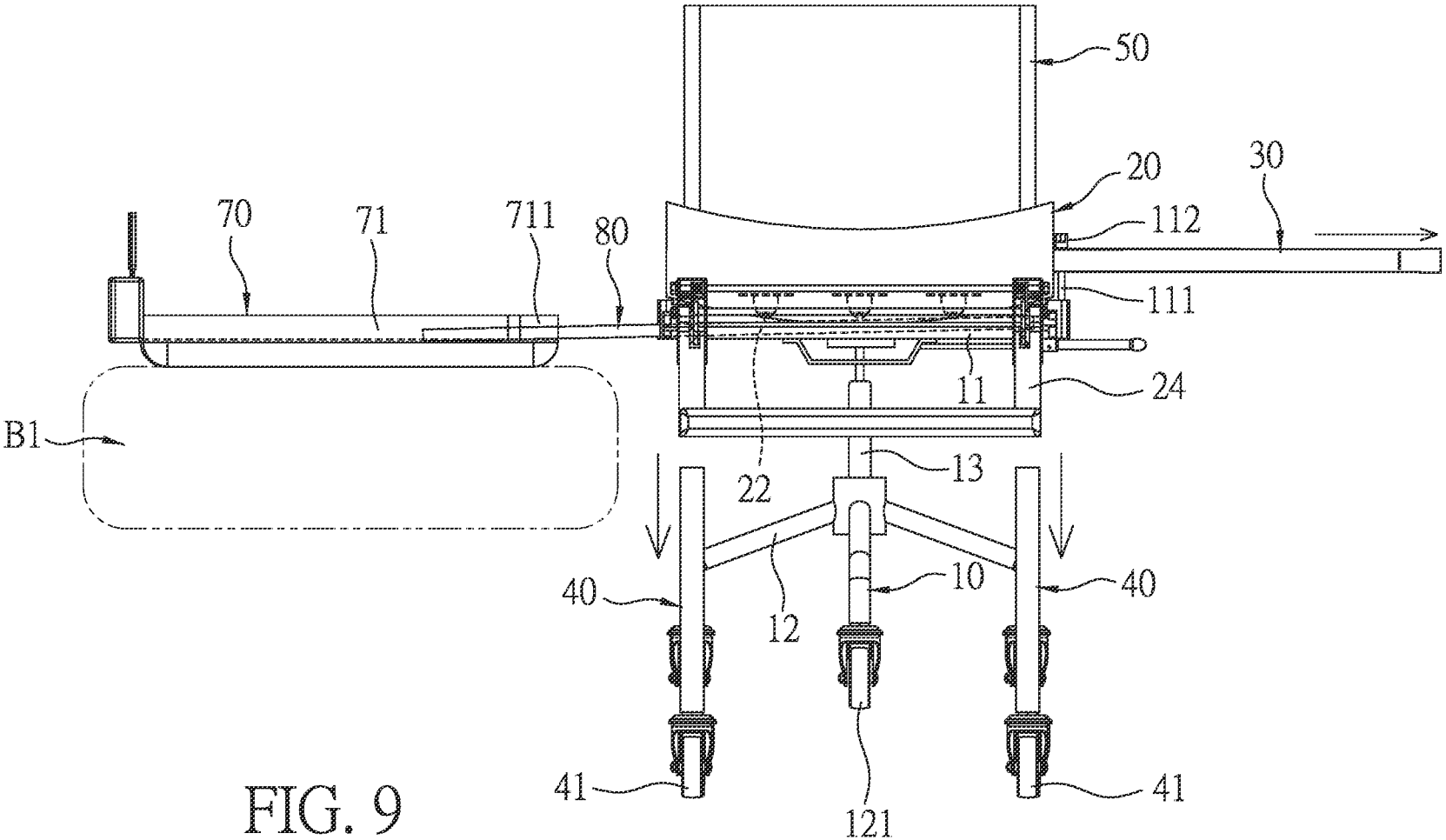
FIG. 9 is also another side plane view showing the operation of the displacement mechanism according to the preferred embodiment of the present invention.
Figure 11:
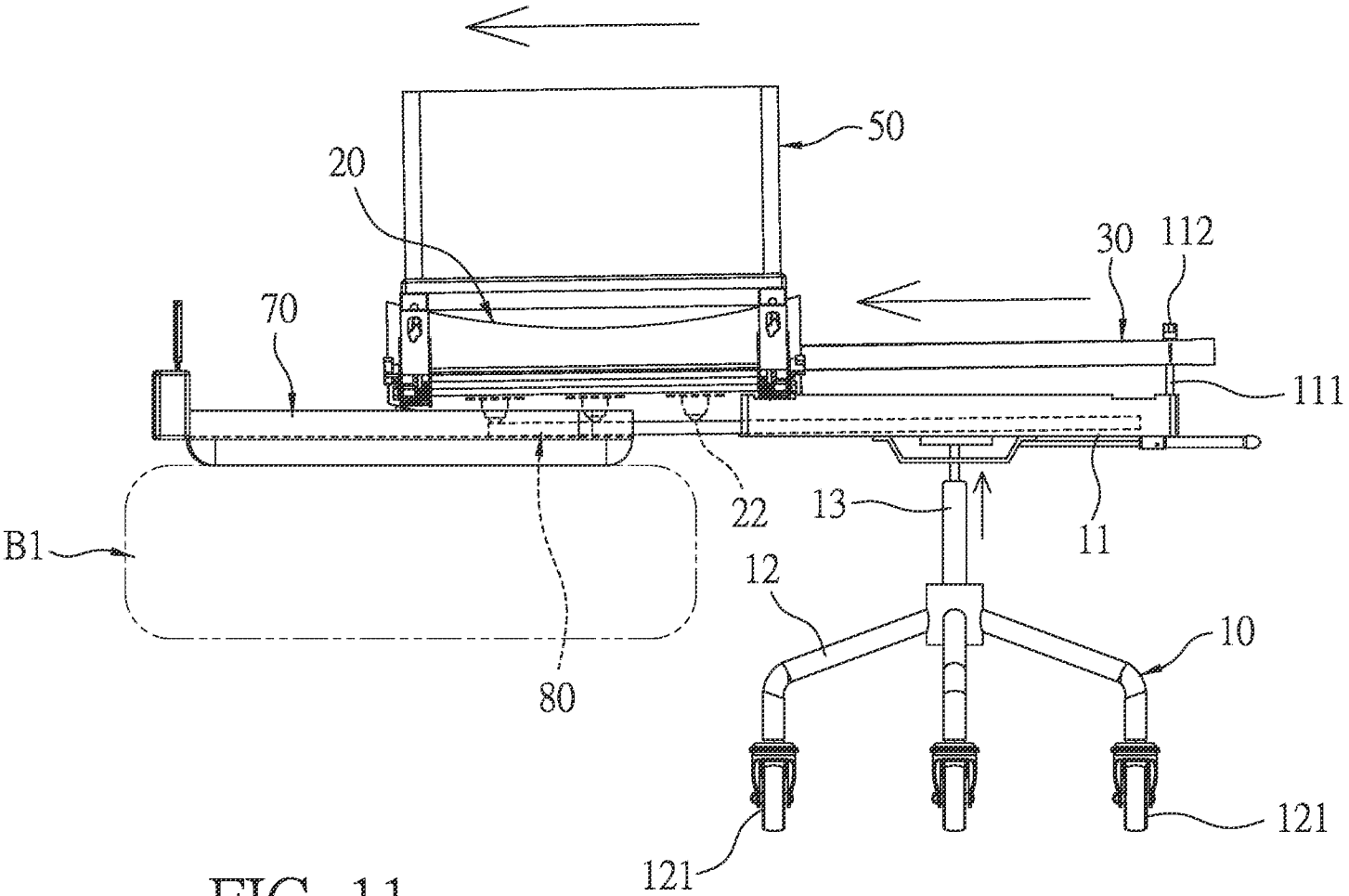
FIG. 11 is another side plane view showing the operation of the displacement mechanism according to the preferred embodiment of the present invention.
Figure 13:
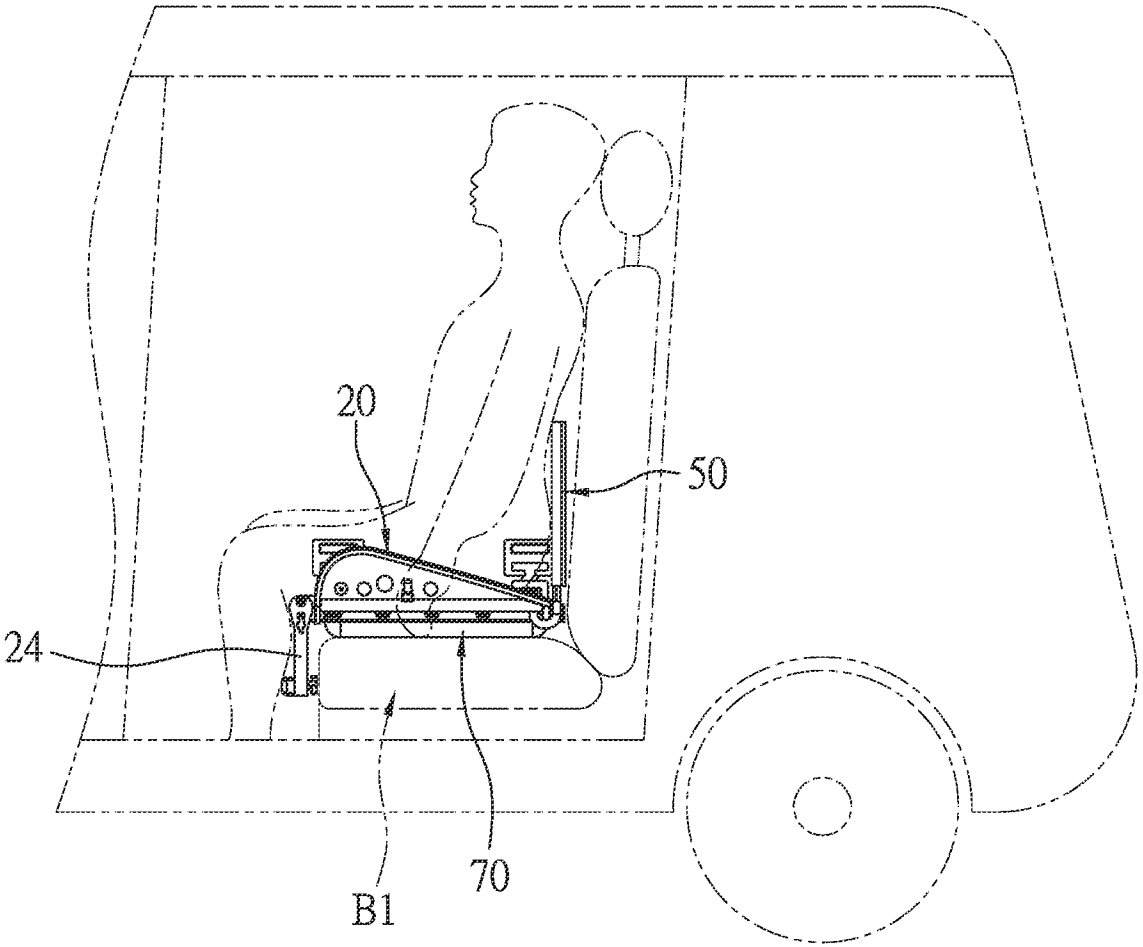
FIG. 13 is still another side plane view showing the operation of the displacement mechanism according to the preferred embodiment of the present invention.

The second holding plate 70 is connected on a seat B1 of the car (as illustrated in FIGS. 9, 11, and 13), the second holding plate 70 includes a groove 71 defined on a top thereof, and the groove 71 has an opening 711 formed on a side thereof.

The expandable sheet 80 is disposed between the fixer 11 of the support rack 10 and the second holding plate 70 so that the sitting assembly 20 slides between the fixer 11 of the support rack 10 and the second holding plate 70 by using the multiple rotation elements 22.

Figure 6:
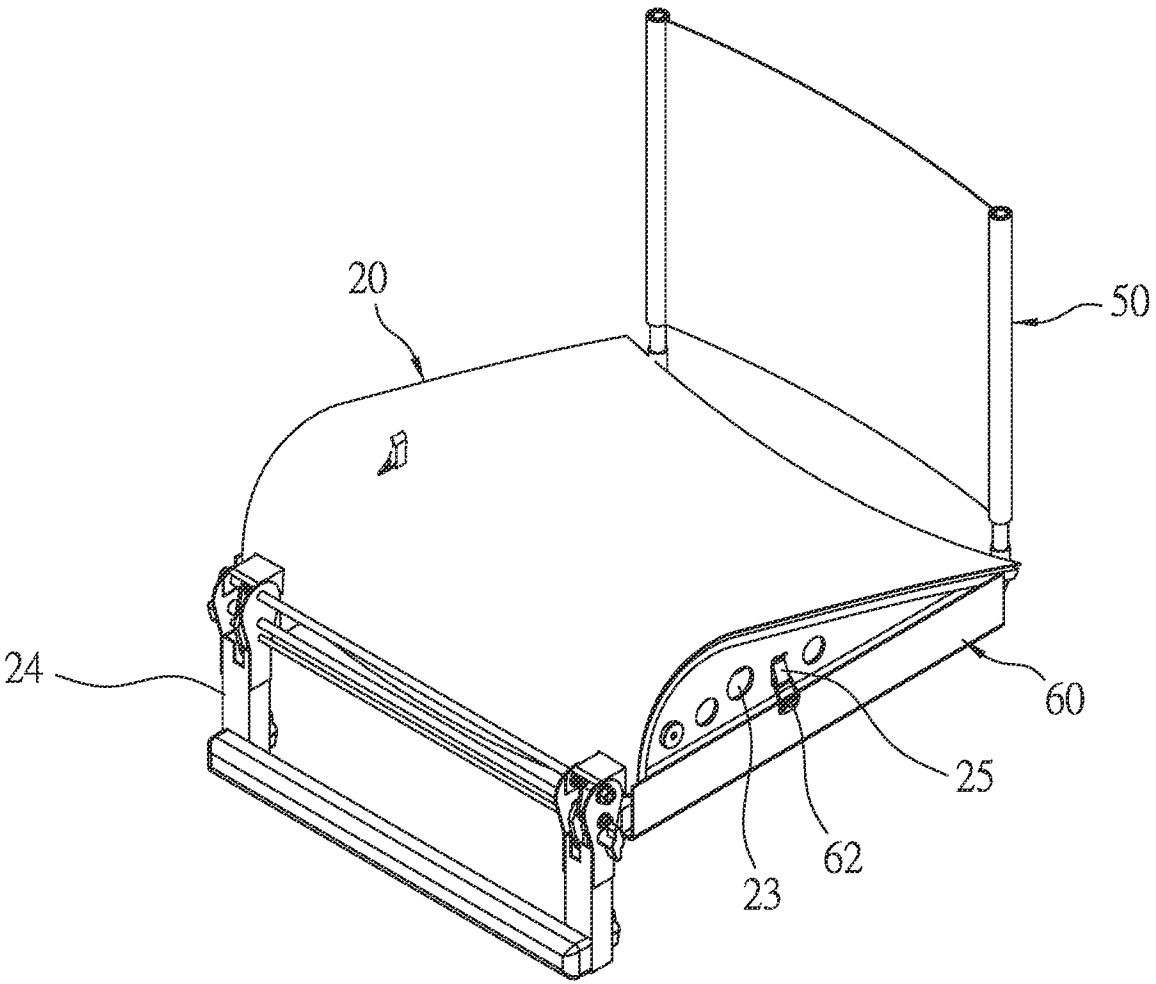
FIG. 6 is a perspective view showing the assembly of the sitting assembly and the first holding plate of the displacement mechanism according to the preferred embodiment of the present invention.

In operation, the first holding plate 60 is connected on the seat A1 of the wheelchair (as shown in FIGS. 4 and 5), and the second holding plate 70 is fixed on the seat B1 of the car (as illustrated in FIGS. 9, 11, and 13), wherein the sitting assembly 20 is slidably mounted on the two second slide rails 61 of the first holding plate 60 by way of the two first slide rails 21, and the two retainers 25 of the sitting assembly 20 are engaged with the two hooks 62 of the first holding plate 60 (as illustrated in FIG. 6) so that the sitting assembly 20 is secured on the first holding plate 60 (i.e. the seat A1 of the wheelchair), and a disabled person sits on the sitting assembly 20 and moves with the wheelchair.

Figure 7:
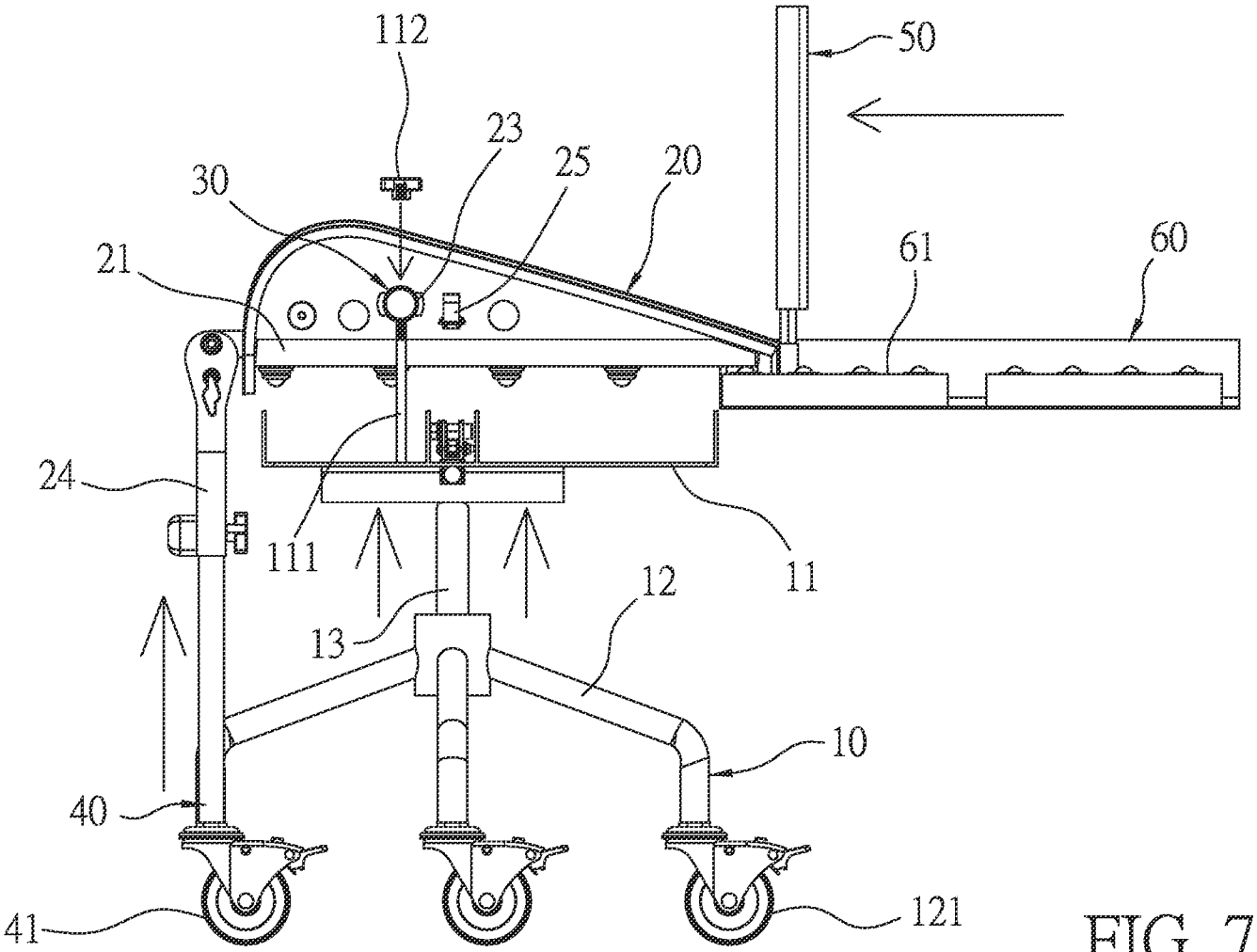
FIG. 7 is a side plane view showing the operation of the displacement mechanism according to the preferred embodiment of the present invention.
Figure 8:
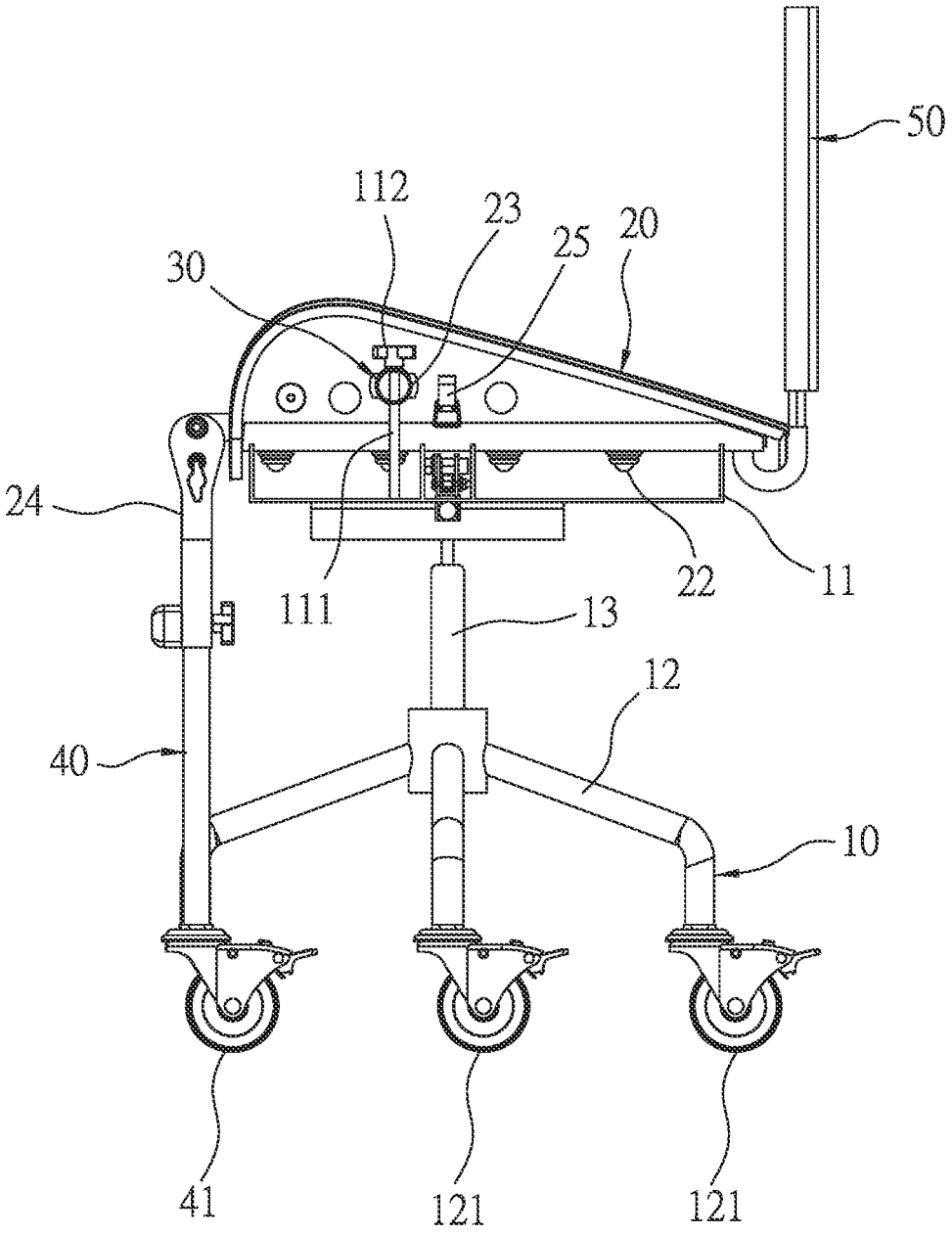
FIG. 8 is another side plane view showing the operation of the displacement mechanism according to the preferred embodiment of the present invention.
Figure 10:
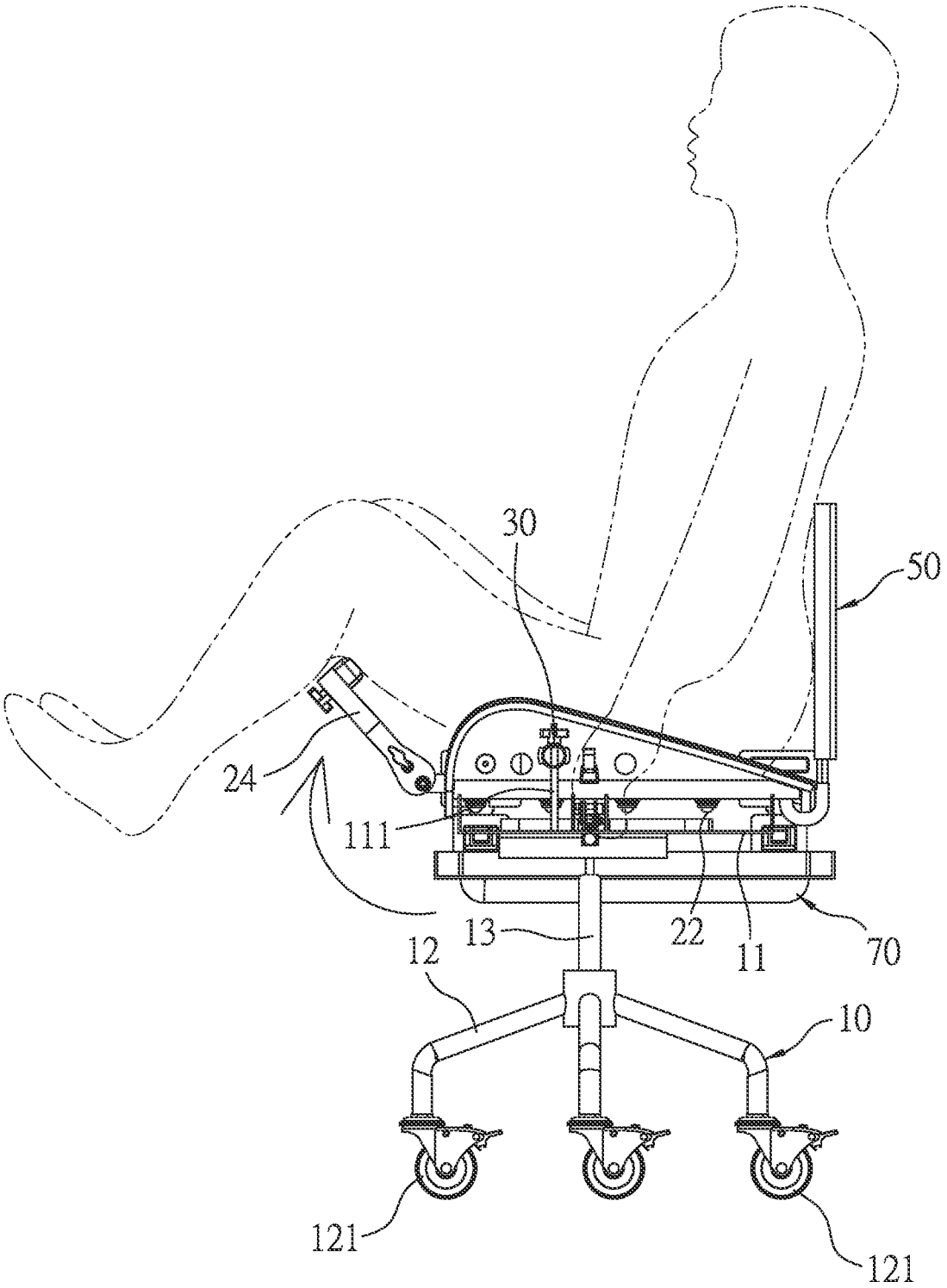
FIG. 10 is still another side plane view showing the operation of the displacement mechanism according to the preferred embodiment of the present invention.
Figure 12:
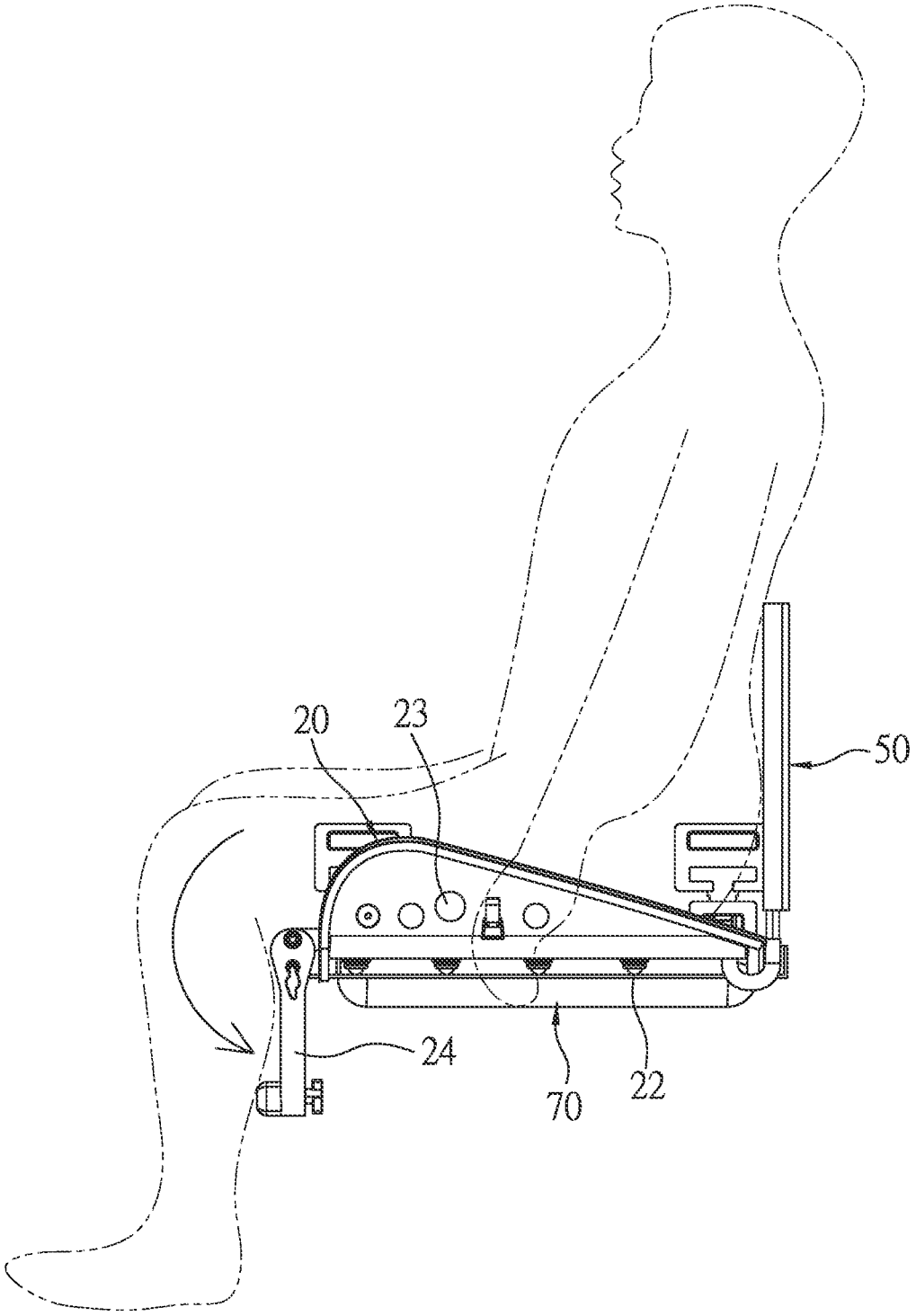
FIG. 12 is also another side plane view showing the operation of the displacement mechanism according to the preferred embodiment of the present invention.

When moving the disabled person to the seat B1 of the car, as shown in FIGS. 7 and 8, the rotatable mounting 24 of the sitting assembly 20 is adjustably moved upward, the two fixing feet 40 are mounted on the two bottoms of the two side surfaces of the rotatable mounting 24 so that the two second rollers 41 of the two fixing feet 40 abut against a ground slidably, the sitting assembly 20 moves the disabled person to the first holding plate 60 by sliding the two first slide rails 21 and the two second slide rails 61 of the first holding plate 60, and the support rack 10 slides beneath the sitting assembly 20, then the lifter 13 of the support rack 10 lifts the fixer 11 upward so that the two first slide rails 21 of the sitting assembly 20 are fixed on the fixer 11 of the support rack 10, the two first slide rails 21 are engaged with the multiple cutouts 113 of the fixer 11 of the support rack 10, and the slide rod 30 is slidably accommodated in the receiving orifice 23 of the sitting assembly 20 so that the sitting assembly 20 is connected on the support rack 10 and is slidably moved beside the seat B1 of the car by using the multiple first rollers 121 of the support rack 10 and the two second rollers 41 of the two fixing feet 40, and the expandable sheet 80 is fixed between the fixer 11 of the support rack 10 and the second holding plate 70 (as shown in FIG. 9), the two fixing feet 40 are removed from the two bottoms of the two side surfaces of the rotatable mounting 24, the slide rod 30 is slid away from the second holding plate 70, and the rotatable mounting 24 of the sitting assembly 20 is rotated upward so that the two feet of the disabled person are lifted by the rotatable mounting 24 (as shown in FIG. 10). Then, the lifter 13 of the support rack 10 lifts the fixer 11 upward higher than the second holding plate 70 so that the disabled person on the sitting assembly 20 is moved to the second holding plate 70 slidably (as illustrated in FIG. 11). After the sitting assembly 20 and the disabled person are moved onto the second holding plate 70 (the seat B1 of the car), the sitting assembly 20 and the second holding plate 70 are fixed, and the rotatable mounting 24 of the sitting assembly 20 is rotated downward so that the two feet of the disabled person are put downward (as shown in FIGS. 12 and 13), thus moving the disabled person to the seat B1 of the car completely.

Figure 14:
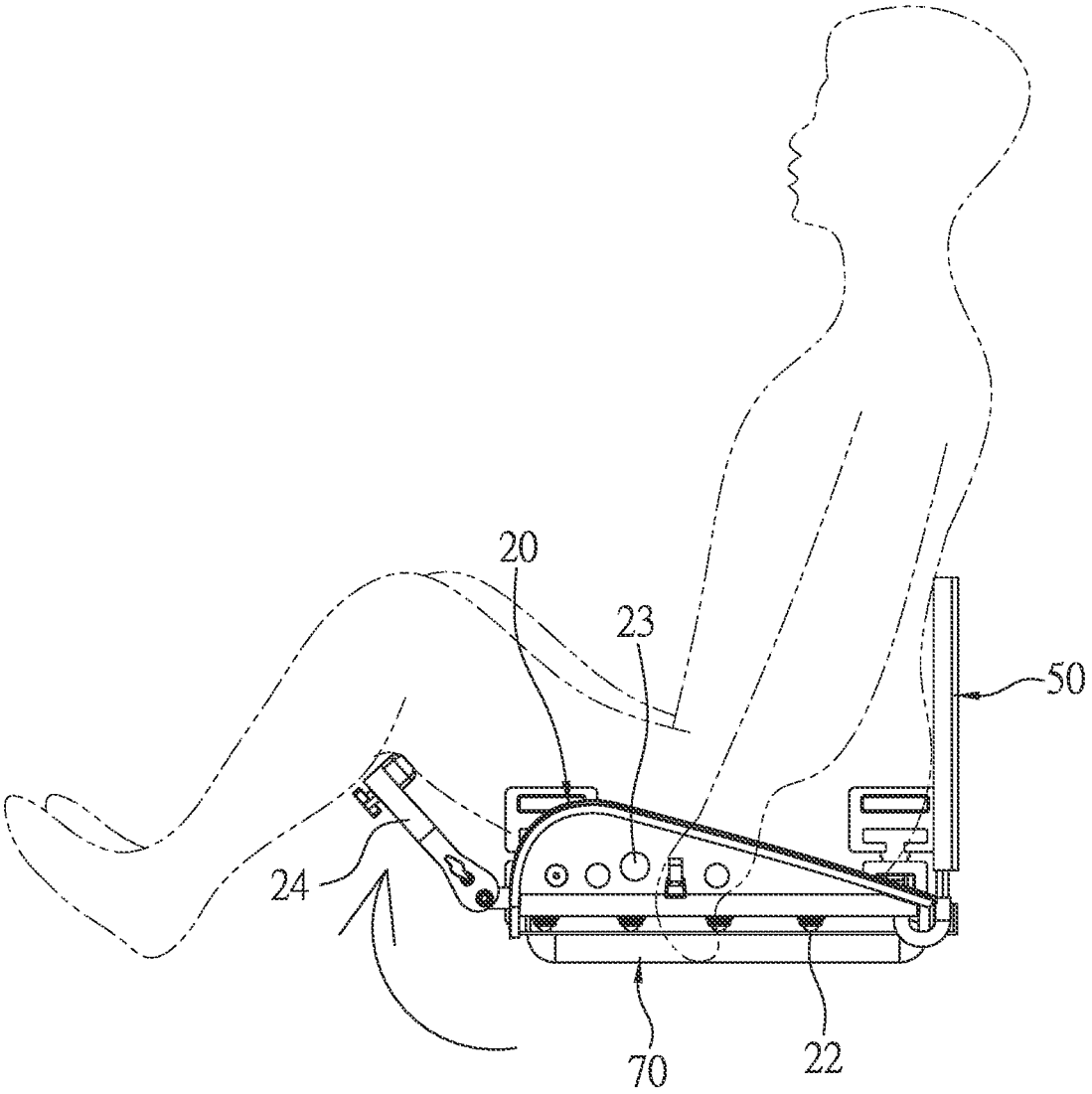
FIG. 14 is another side plane view showing the operation of the displacement mechanism according to the preferred embodiment of the present invention.
Figure 15:
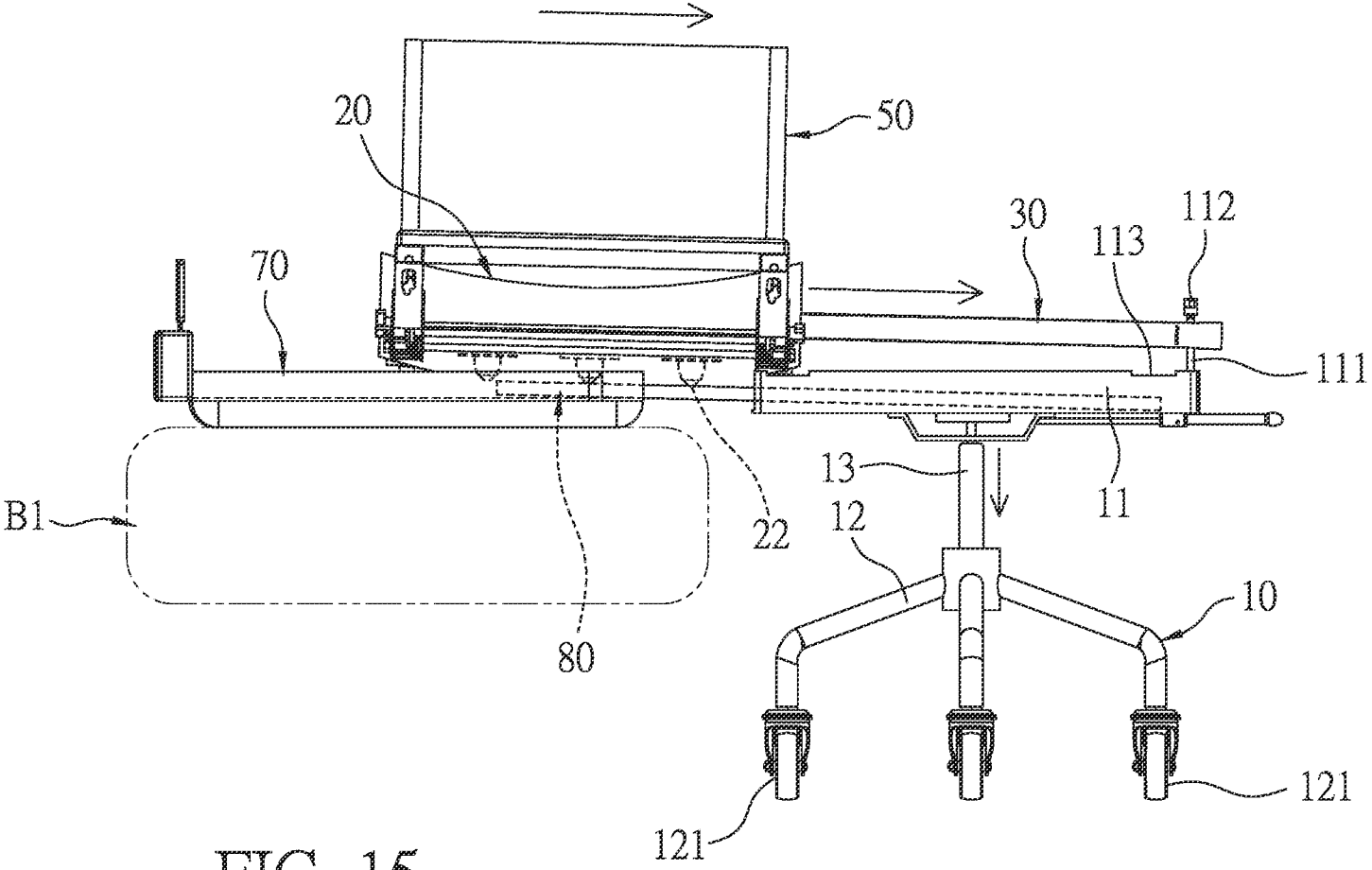
FIG. 15 is also another side plane view showing the operation of the displacement mechanism according to the preferred embodiment of the present invention.
Figure 16:
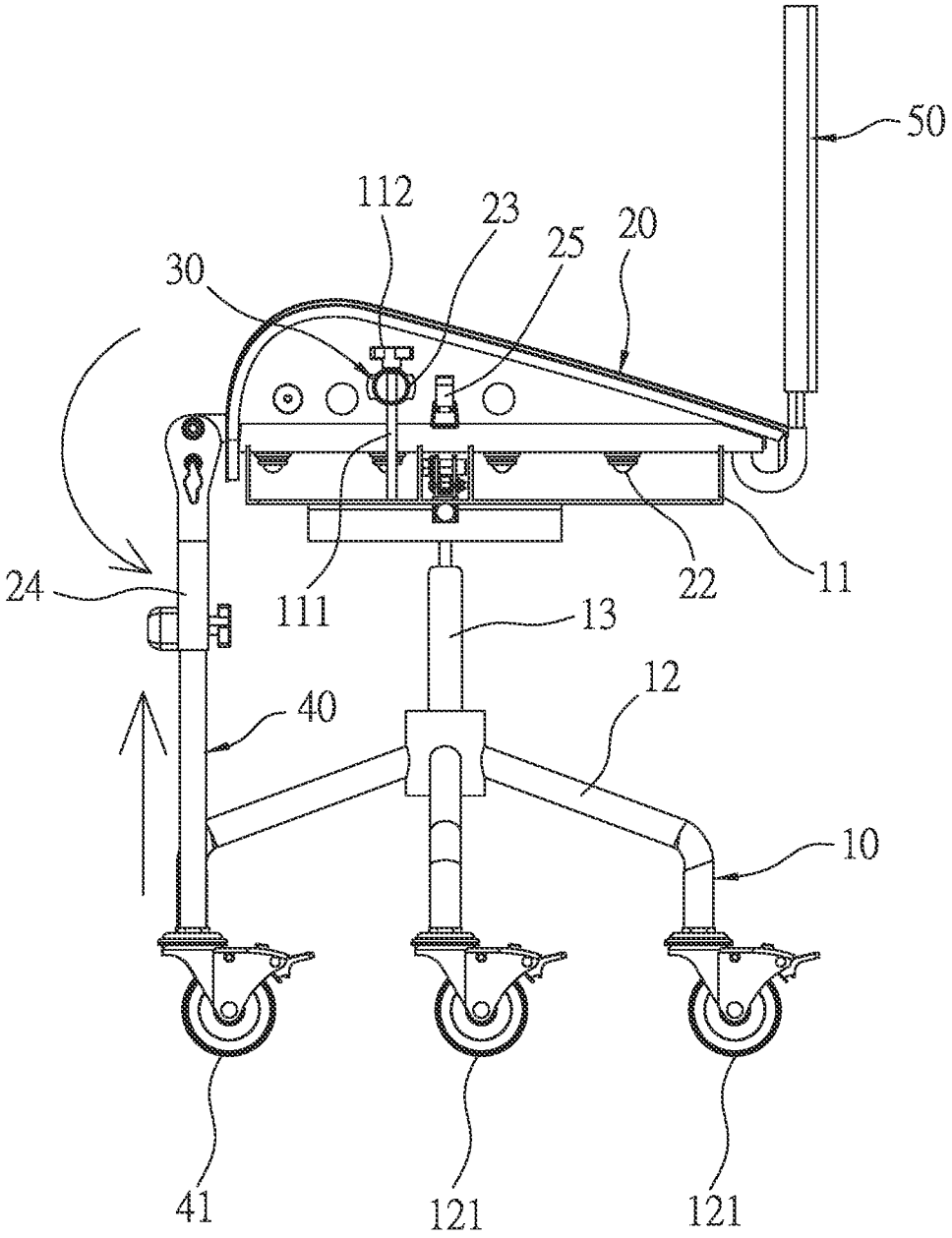
FIG. 16 is still another side plane view showing the operation of the displacement mechanism according to the preferred embodiment of the present invention.
Figure 17:
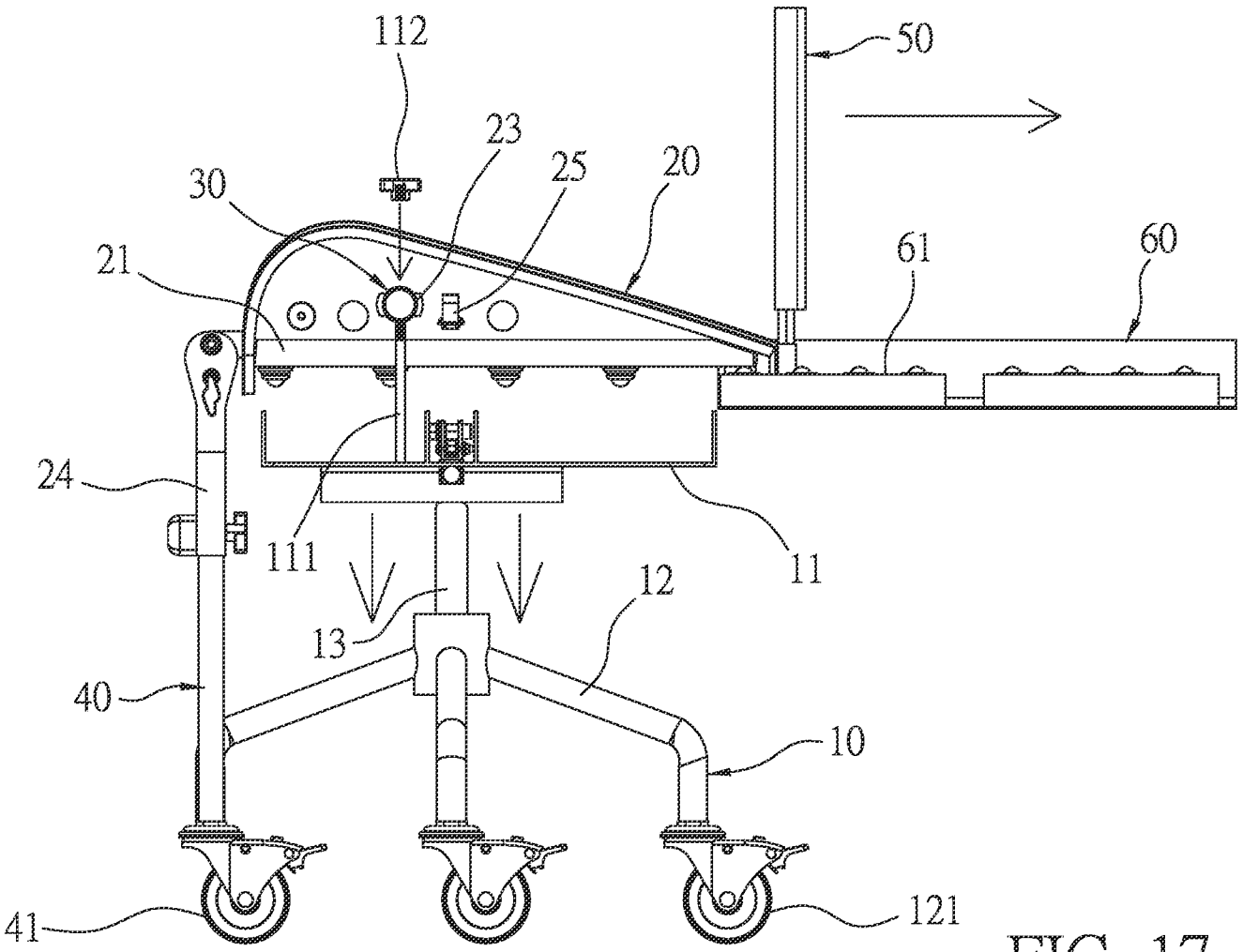
FIG. 17 is another side plane view showing the operation of the displacement mechanism according to the preferred embodiment of the present invention.

When moving the disabled person to the seat A1 of the wheelchair, as shown in FIG. 14, the rotatable mounting 24 of the sitting assembly 20 is rotated upward to lift the two feet of the disabled person, the support rack 10 is moved slidably beside the seat B1 of the car, the expandable sheet 80 is fixed between the fixer 11 of the support rack 10 and the second holding plate 70 (as shown in FIG. 15), the lifter 13 of the support rack 10 descends the fixer 11 downward lower than the second holding plate 70 so that the disabled person on the sitting assembly 20 is moved to the fixer 11 slidably by sliding the slide rod 30 in the receiving orifice 23 of the sitting assembly 20 until the sitting assembly 20 and the disabled person are moved onto the fixer 11 of the support rack 10. Thereafter, the two first slide rails 21 of the sitting assembly 20 are engaged with the multiple cutouts 113 of the fixer 11 of the support rack 10, the rotatable mounting 24 of the sitting assembly 20 is rotated downward so that the two feet of the disabled person are put downward (as shown in FIG. 16), wherein the two fixing feet 40 are connected on the two bottoms of the two side surfaces of the rotatable mounting 24 so that the two second rollers 41 of the two fixing feet 40 abut against the ground slidably, and the support rack 10 and the two fixing feet 40 are slid to abut against a front end of the seat A1 by way of the multiple first rollers 121 and the two second rollers 41, then the sitting assembly 20 and the disabled person are moved onto the first holding plate 60 of the seat A1 of the wheelchair slidably, such that the two first slide rails 21 of the sitting assembly 20 contact with the two second slide rails 61 of the first holding plate 60 (as illustrated in FIG. 17) partially, the support rack 10 are removed from the bottom of the sitting assembly 20 slidably, the sitting assembly 20 and the first holding plate 60 are slid by using the two first slide rails 21 and the two second slide rails 61 so that the sitting assembly 20 and the disabled person are moved onto the first holding plate 60 slidably, then the two retains 25 of the sitting assembly 20 are engaged with the two hooks 62 of the first holding plate 60 so that the sitting assembly 20 is connected on the first holding plate 60 (i.e., the seat A1 of the wheelchair), and the two fixing feet 40 are removed from the two bottoms of the rotatable mounting 24, thus moving the disabled person to the seat A1 of the wheelchair.

Accordingly, the displacement mechanism has advantages as follows:

1. The displacement mechanism is simplified, produced at a low cost, sold at a low price, and used flexibly.

2. The displacement mechanism is capable of moving the disabled person upward and downward easily and quickly.

While various embodiments in accordance with the present invention have been shown and described, it is clear to those skilled in the art that further embodiments may be made without departing from the scope of the present invention.

What is claimed is:

1. A displacement mechanism for getting a disabled person into and out of a car comprising:

a support rack including a fixer formed on a top of the support rack, a rolling stand connected on a bottom of the support rack, the rolling stand having multiple first rollers mounted on a bottom of the rolling stand, the support rack further including a lifter defined between the fixer and the rolling stand, and the fixer having a post extending upward from a side of the fixer;

a sitting assembly slidably mounted on the fixer of the support rack, the sitting assembly including a receiving orifice defined on one of two side surfaces of the sitting assembly, and the sitting assembly including a rotatable mounting rotatably connected on a front end of the sitting assembly;

a slide rod including an elongated hole defined on the slide rod and configured to connect the slide rod with the post of support rack, such that the slide rod slides with respect to the post and is slidably received in the receiving orifice of the sitting assembly;

two fixing feet mounted on two bottoms of two side surfaces of the rotatable mounting, and a respective foot including a second roller connected on a bottom of the respective foot;

a back disposed on a rear end of the sitting assembly;

a first holding plate mounted on a seat of a wheelchair, and the sitting assembly sliding between the fixer of the support rack and the first holding plate;

a second holding plate connected on a seat of the car; and an expandable sheet disposed between the fixer of the support rack and the second holding plate so that the sitting assembly slides between the fixer of the support rack and the second holding plate.

2. The displacement mechanism as claimed in claim 1, wherein the fixer has a screw nut screwed on the post.

3. The displacement mechanism as claimed in claim 1, wherein the fixer has multiple cutouts formed on two sides of a top thereof, the sitting assembly includes two first slide rails arranged on two sides of a bottom thereof and configured to fix the sitting assembly on the fixer of the support rack, and the two first slide rails are engaged with the multiple cutouts of the fixer of the support rack.

4. The displacement mechanism as claimed in claim 3, wherein the sitting assembly further includes multiple rotation elements disposed between the two first slide rails of the bottom of the sitting assembly.

5. The displacement mechanism as claimed in claim 1, wherein the sitting assembly further includes two retainers fixed on the two side surfaces thereof, the first holding plate includes two hooks formed on two side surfaces thereof, such that the two retainers of the sitting assembly are engaged with the two hooks of the first holding plate so that the sitting assembly is secured on the first holding plate.

6. The displacement mechanism as claimed in claim 3, wherein the first holding plate includes two second slide rails formed on two sides of a top thereof and configured to slide with respect to the two first slide rails of the sitting assembly.

7. The displacement mechanism as claimed in claim 1, wherein the second holding plate includes a groove defined on a top thereof, and the groove has an opening formed on a side thereof.

* * * * *